US005739448A

United States Patent [19]

Toscano

[11] Patent Number: 5,739,448

[45] Date of Patent: Apr. 14, 1998

[54] DRUM TUNING SYSTEM

[75] Inventor: Elisandro Toscano, Orange, Calif.

[73] Assignee: Michael Frankel, North Hollywood, Calif.

[21] Appl. No.: 730,780

[22] Filed: Oct. 16, 1996

[51] Int. Cl.[6] ..... G10D 13/02

[52] U.S. Cl. ..... 84/413; 84/411 R; 84/411 A

[58] Field of Search ..... 84/413, 411 A, 84/411 R, 419, 412

[56] References Cited

U.S. PATENT DOCUMENTS

| | | | |
|---|---|---|---|
| 1,204,182 | 11/1916 | O'Connor | 84/413 |
| 2,425,996 | 8/1947 | Cordes | 84/411 R |
| 3,439,573 | 4/1969 | Zottolo | 84/413 |

*Primary Examiner*—Cassandra C. Spyrou
*Attorney, Agent, or Firm*—Charles H. Thomas

[57] ABSTRACT

An improved tuning system is provided for a musical percussion drum. The tuning system utilizes an inverted J-shaped counterhoop that is threadably engaged with an externally threaded, outwardly facing tuning rim surface on a tuning collar that is secured to the drum shell. An interior portion of the counterhoop projects downwardly into a channel defined between the externally threaded tuning rim of the tuning collar and a bearing ring on the tuning collar located inwardly and separated from the tuning rim by the channel. The pressure ring bears downwardly on a hoop that is secured to the periphery of the drum skin. Rotation of the counterhoop in one direction screws the counterhoop further onto the drum shell, thereby tightening the drum skin. Counterrotation of the counterhoop in the opposite direction loosens the drum skin. Rotation is achieved by engagement of a pair of driving gears supported by a gear mount attached to the outer surface of the tuning collar. The driving gear teeth engage ring gear teeth that project radially outwardly from the counterhoop. Rotation of one of the driving gears in either of two alternative directions provides gross incremental adjustment in tension on the drum skin. The second driving gear provides a finer adjustment in tension. A pawl mechanism is selectively engageable with the driving gears to prevent the counterhoop from unscrewing from the tuning rim.

16 Claims, 4 Drawing Sheets

DRUM TUNING SYSTEM

BACKGROUND OF THE INVENTION

1. Field of the Invention

The present invention relates to a system for tuning a musical percussion drum.

2. Description of the Prior Art

Musical percussion drums of the type used to maintain an audible rhythm in playing a musical work are tuned by placing a drum skin across the annular bearing rim of a shell or drum chamber and by pressing a hoop over the skin near its circumference. The hoop is tightened down to stretch the skin across the bearing rim of the drum shell. This tightening is typically achieved by screws spaced periodically about the circumference of the drum shell and which vary the force with which the hoop is pressed on to the shell.

The problem with such a conventional system is that the longitudinal force pressing the hoop toward the drum shell is exerted only at specified locations about the periphery of the skin. Therefore, there is an inherent nonuniformity in tension about the periphery of the drum skin due to variations with which the hoop applies force throughout its circumference. Moreover, further disparities in tensioning force result since each screw is tightened separately.

Other drum tuning systems have also been devised. U.S. Pat. No. 2,425,996 is directed to a system of tensioning a snare drum by the application of power at a single point. In this arrangement a pinion is housed within a hollow rib located on a retaining hoop that encircles the drum shell. The pinion meshes with teeth of an annular tensioning ring. The tensioning ring bears upon a thrust ring which remains stationary relative to the drum shell. Ball bearings allow the thrust ring to remain still while allowing the tensioning ring to advance in rotation. The tensioning ring is externally threaded and is screwed into internal threads defined on the retaining hoop. The outer periphery of the tensioning ring is provided with external gear teeth so that the tensioning ring also constitutes a ring gear engageable by the pinion.

In the operation of the device shown in the '996 patent the pinion is meshed with the ring gear teeth of the tensioning ring. The thread grooves on the pinion ring intersect the teeth of the tensioning ring. Therefore, by rotating the pinion, the tensioning ring may be turned and threaded inwardly, thereby causing the thrust ring to force the adjacent portion of the skin into the opening at the outer side of a flesh hoop to tension the skin as desired. The thrust ring and the skin do not rotate with the tensioning ring. Rather, the ball bearings allow the tensioning ring to rotated relative to the thrust ring while bearing axially thereagainst.

The system of U.S. Pat. No. 2,425,996 has a significant defects, however. In that device, the interior surface of the retaining hoop is threaded with female threads, while the tensioning ring is externally threaded with male threads. Thus, the structure of the retaining hoop surrounds the structure of the tensioning ring. This means that only a single, very small pinion can be employed since it must fit into the very confined space between the retaining hoop and the tensioning ring. This severely limits the mechanical advantage that can be employed to tighten the drum skin.

According to the present invention, a system is provided in which the drum head or skin can be stretched across the bearing ring of the drum shell with far greater uniformity throughout the circumference of the skin than has heretofore been possible. According to the present invention, the longitudinal extremities of the drum shell, or axial extensions of the drum shell, have tuning collars secured thereto that each define an externally threaded tuning rim and a bearing ring located coaxially therewithin and separated therefrom by a channel. An annular ring on a counterhoop of the drum presses downwardly in the channel on a hoop secured to the periphery of the drum skin. The counterhoop is internally threaded, so that it can be advanced directly onto the tuning rim of the drum in threaded engagement therewith. Thus, rotation of the counterhoop with a screwing action advances it onto the exteriorly facing threads of the tuning rim and tightens the skin thus increasing peripheral tension uniformly throughout the skin. Conversely, when the counterhoop is counter-rotated, tension is uniformly decreased as the threaded counterhoop is backed off of the threads of the tuning rim.

Furthermore, the mechanical advantage of rotation and counter-rotation of the counterhoop relative to the drum shell may be controlled by a drive mechanism having a selection of speeds or motion transmission ratios. The counterhoop is provided with radially outwardly projecting ring gear teeth on its outer surface. These teeth may be engaged by gear teeth of a plurality of driving gears having different pitch diameters and mounted on a bracket or gear mount which projects radially outwardly from the tuning collar relative to the side of the drum shell. Keys are employed to alternatively rotate the drive gears which both engage the ring gear teeth on the outer surface of the counterhoop. Preferably, there is a gross adjustment driving gear which rotates the counterhoop in threaded engagement relative to the shell in incremental steps, each step corresponding to one semitone or one-twelfth of a twelve step chromatic octave, the standard repeating base scale for all Western music. For individuals who prefer finer tuning the gear mechanism also preferably includes a second driving gear that allows finer timing adjustments to be made.

The counterhoop is internally threaded with female threads and the tuning rim on the tuning collar is externally threaded with male threads. The counterhoop fits over the edge of the tuning rim and is accessible from the exterior of the shell of the drum. This allows the outwardly facing surface of the counterhoop to be provided with radially outwardly directed gear teeth. Furthermore, one or more driving gears can be mounted on the exterior of the drum shell and are engaged with the gear teeth that project radially from the counterhoop. The different pitch diameters of the driving gears permit adjustment of the drum tuning with alternative mechanical advantages. As a result, the tuning mechanism can be operated to achieve either fine or gross adjustment.

A key is preferably employed to operate each driving gear so as to further screw or further unscrew the counterhoop on the drum shell in either large or small increments of advancement or withdrawal as desired by the person tuning the drum. The system preferably employs a pair of driving gears of different pitch diameters, both engaged directly with the gear teeth on the ring gear on the outer surface of the counterhoop.

A first, relatively large, driving gear is engageable with the radially outwardly projecting teeth on the counterhoop. This provides a gross or coarse adjustment mechanism. A turning key is used to rotate the first driving gear located on the gear mount with physical ease. A ratchet pawl may be provided to latch between the teeth of the driving gear as it is rotated to screw the counterhoop onto the tuning rim. When engaged, the pawl prevents retrograde rotation of the driving gear as each tooth of the driving gear passes. The pawl also allows tightening (stretching) of the drum skin in precise increments to a desired setting. These increments are based on a logarithm which follows increments based on the frequency response of a human ear as relative to the aforementioned increment designated one semitone.

Preferably, the driving ratio of the coarse gear mechanism is set up so that with each advancement of the tooth of the first driving gear the frequency produced by the drum skin changes by either a full musical note or by one-half of a full musical note. Using this system, even a hearing impaired person can tune a drum visually by noting the position of the radially projecting teeth on the counterhoop relative to the driving gear. Also, the change in full notes or half notes can be monitored by counting the clicks of a rachet pawl with each incremental advancement of a tooth of the first driving gear.

Alternatively, the system is also capable of fine tuning. In this case a second, smaller diameter driving gear is employed that is also engaged directly with the ring gear teeth on the outer face of the counterhoop. When engaged the second driving gear rotates the counterhoop at but a fraction of the rate of rotation that is achieved when the system is operated for gross tuning using the first driving gear.

The system of the invention has a further advantage. Because the teeth of the counterhoop project radially outward beyond the shell of the drum, the gear mechanism used to effectuate tuning can be mounted on a tuning collar, rather than directly to the drum shell. This separates the entire tuning gear mechanism from the drum shell. The use of an intermediate tuning collar interposed between the adjustment mechanism and the drum shell is highly desirable, since hardware attached directly to the drum shell detracts from the resonance produced from the hollow chamber of the drum.

The prior system of screws periodically spaced about the perimeter of the drum shell, and the prior system of U.S. Pat. No. 2,425,996 suffer from diminished resonance in that a significant mount of hardware remains attached on the drum shell when the drum is played. In contrast, the system of the present invention is such that the gear hardware is supported on a mount held cantilevered out from the drum shell. The unique tuning system of the invention solves the problem of resonance attenuation by eliminating all hardware attached directly to the drum shell when the drum is being played.

SUMMARY OF THE INVENTION

In one broad aspect the present invention may be considered to be a musical percussion drum comprised of a drum shell, a tuning collar secured to the drum shell and including an annular bearing ring and a tuning rim coaxially surrounding the bearing ring so as to define an annular channel therebetween and wherein the tuning rim has a radially outwardly facing, externally threaded, annular surface. An expansive drum skin is stretched across the bearing ring and has a periphery extending into the channel throughout its entire circumference. A rigid, annular hoop is secured to the periphery of the drum skin and resides in the channel. An annular counterhoop is provided and is formed with an outer, annular, inwardly facing, internally threaded portion that is threadably engaged with the externally threaded surface of the tuning rim. The counterhoop has an inner, annular portion disposed in the channel and bearing downwardly upon the annular hoop. A web joins the inner and outer portions of the counterhoop rigidly together longitudinally beyond the tuning rim so that the web spans and is longitudinally displaced from the tuning rim.

Preferably the counterhoop is provided with radially outwardly projecting ring gear teeth. The tuning system also preferably is comprised of a gear mount secured to the tuning collar and supporting at least one driving gear. The driving gear is mounted for rotation about a driving gear axis so as to engage the ring gear teeth on the counterhoop. The driving gear thereby rotates the counterhoop relative to the drum shell to selectively tighten and loosen the counterhoop relative to the tuning rim.

The drum tension adjustment system preferably provides alternative driving gears of different gear pitch diameters all engaged with the ring gear teeth on the counterhoop for effectuating fine and coarse or gross tuning. In this embodiment a plurality of driving gears are located on the gear mount and are mounted for rotation about parallel driving gear axes. The system is provided with pitch selection means for selectively engaging each of the driving gears to thereby rotate the counterhoop relative to the drum shell in selected increments. The first and second gears are selectively engageable to rotate the counterhoop at different motion transmission ratios. This rotation selectively tightens and loosens the counterhoop relative to the tuning rim of the drum shell at different mechanical advantages.

A preferred embodiment of the invention employs first and second driving gears, and separate, selectively operable pawl mechanisms engageable with each of those driving gears. The pawl mechanisms are supported by the gear mount and are selectively engageable with a specific one of the driving gears associated therewith. The pawl mechanism, when engaged, prevent rotation of their respective driving gears in a direction that loosens the counterhoop relative to the tuning rim.

In another broad aspect the present invention may be considered to be an improvement to a musical percussion drum having an expansive drum skin, an annular drum shell formed with an annular bearing ring across which the drum skin is stretched and an annular channel surrounding the bearing ring. An annular hoop is secured to the periphery of the drum skin and resides in the channel. According to the improvement of the invention the drum shell in provided with a tuning ring disposed coaxially about the hoop and surrounding the channel and having a radially outwardly facing external, cylindrical surface with screw threads formed thereon concentrically about the axis of the drum shell.

The improvement of the invention is further comprised of an annular counterhoop formed with an outer tensioning band with an inwardly facing, internally threaded, cylindrical surface threadably engaged with the externally threaded surface of the drum shell tuning rim. The counterhoop also includes an annular pressure ring disposed in the channel and a web or bridging section longitudinally displaced from the tuning rim. The bridging section rigidly joins the pressure ring to the outer tensioning band. In this way the position of the pressure ring in the channel is determined by the extent of advance of the internally threaded surface of the outer tensioning band onto the externally threaded surface of the tuning rim.

The invention may be described with greater clarity and particularity by reference to the accompanying drawings.

DESCRIPTION OF THE EMBODIMENT

Figure 1:
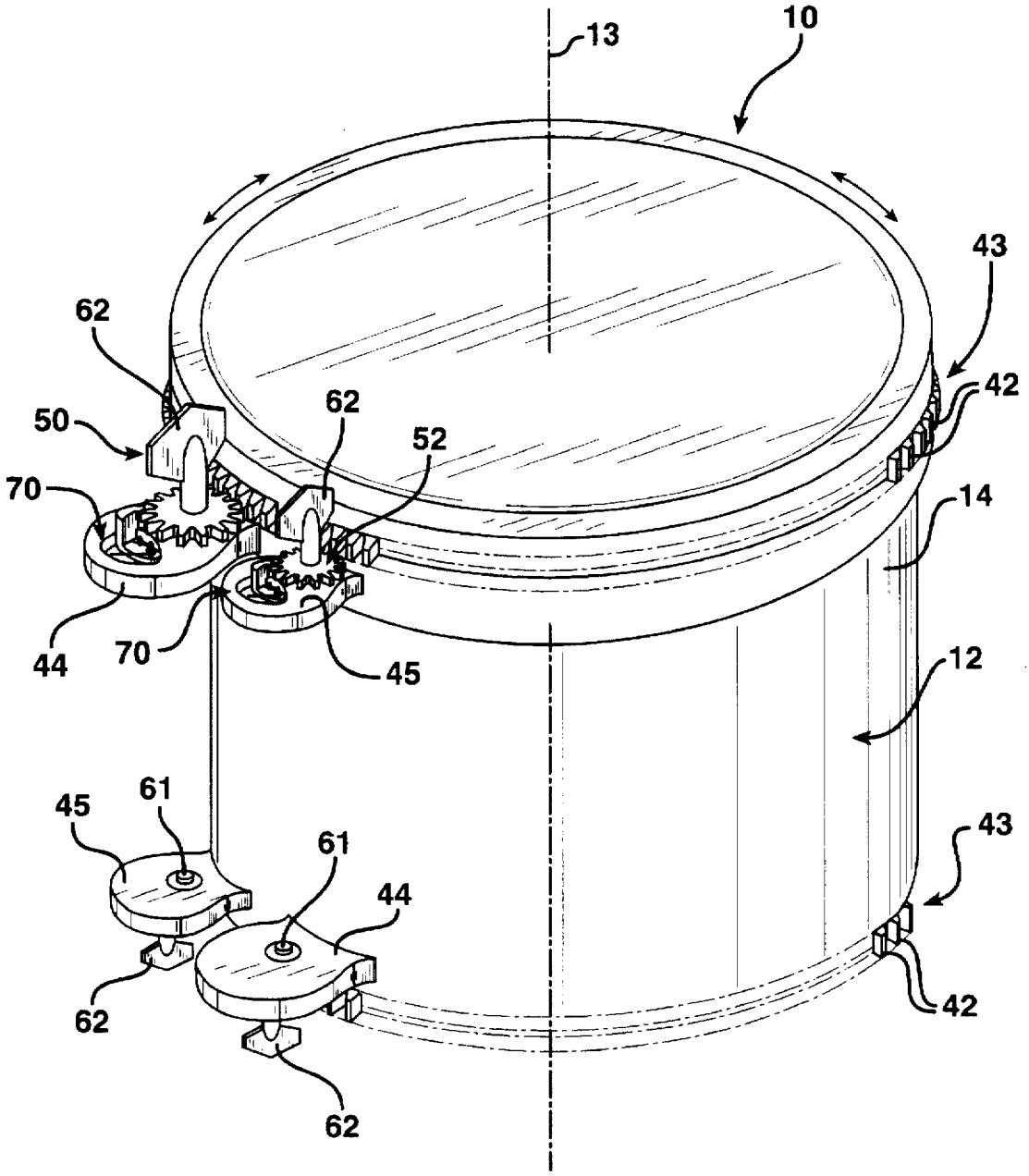
FIG. 1 is a perspective view of an improved drum constructed according to the invention.
Figure 3:
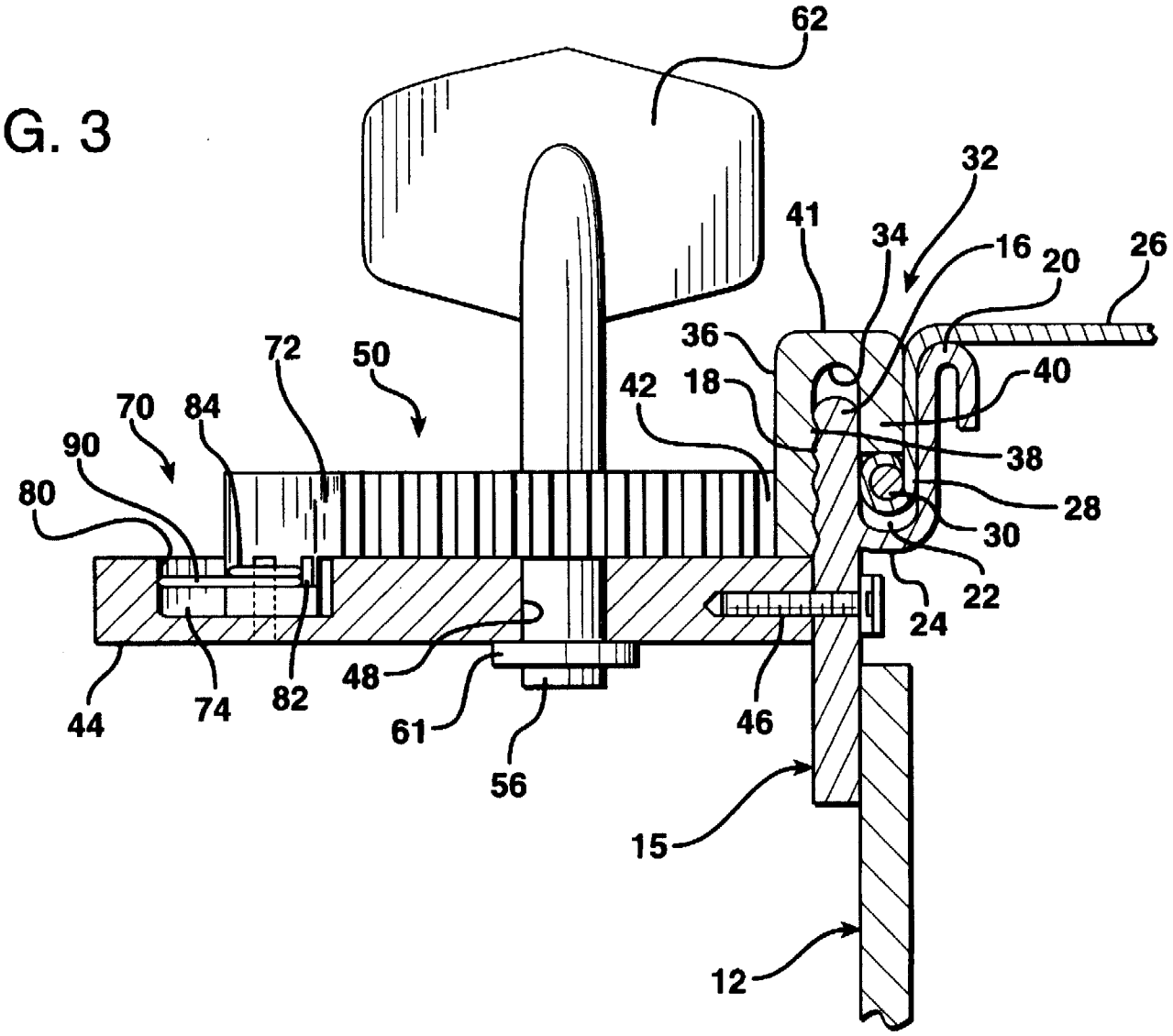
FIG. 3 is a sectional elevational detail taken along the lines 3—3 of FIG. 2 showing the drum tuning system according to the invention operating in a manner to achieve fine adjustment.

FIG. 1 illustrates a musical percussion drum generally at 10 improved according the present invention. The drum 10 is comprised of a metal drum shell 12 having a cylindrical, outer wall 14 that extends longitudinally in both directions about the drum shell axis 13 at the upper and lower extremities of the drum 10. The drum shell 12 is provided with annular tuning collars 15 at both of its longitudinal extremities. The tuning collars 15 are permanently secured to the drum shell 12 such as with an epoxy adhesive. The tuning collars 15 are identical to each other, though of course the tuning collar 16 at the lower edge of the drum shell shown in FIG. 1 is inverted from the tuning collar 15 at the upper drum shell end. Each tuning collar 15 has an annular tuning rim 16, one of which is visible in FIG. 3.

Each tuning rim 16 has an external, threaded, radially outwardly facing, outer surface 18 with screw threads defined thereon coaxially relative to the axis 13 of the drum shell 12. The tuning collar 15 also has an annular bearing rim 20 disposed coaxially within the tuning rim 16 and separated therefrom by an annular channel 22. The bearing 20 rim is preferably fourteen inches in diameter, which is the standard size for many popular musical drums. The tuning rim 16 and the bearing rim 20 are rigidly joined together by a curved connecting region indicated at 24.

The drum 10 is also comprised of a conventional, expansive drum skin 26, which is a thin membrane, typically formed of plastic Mylar® that vibrates at an audible frequency when the drum 10 is properly tuned and the skin 26 is subjected to percussion. The drum skin 26 resides in contact with the bearing ring 20 throughout its circumference. The drum skin 26 has a peripheral region 28 extending radially outwardly beyond the bearing ring 20 and into the channel 22.

A closed, annular hoop 30, of circular cross section, is secured to the peripheral region 28 of the drum skin 26 and resides in the channel 22. The peripheral region 28 may be held against the annular hoop 30 either by adhesive, or merely by the force of friction. In any event the peripheral region 28 of the drum skin 26 is firmly attached to and immobilized relative to the hoop 30.

Figure 2:
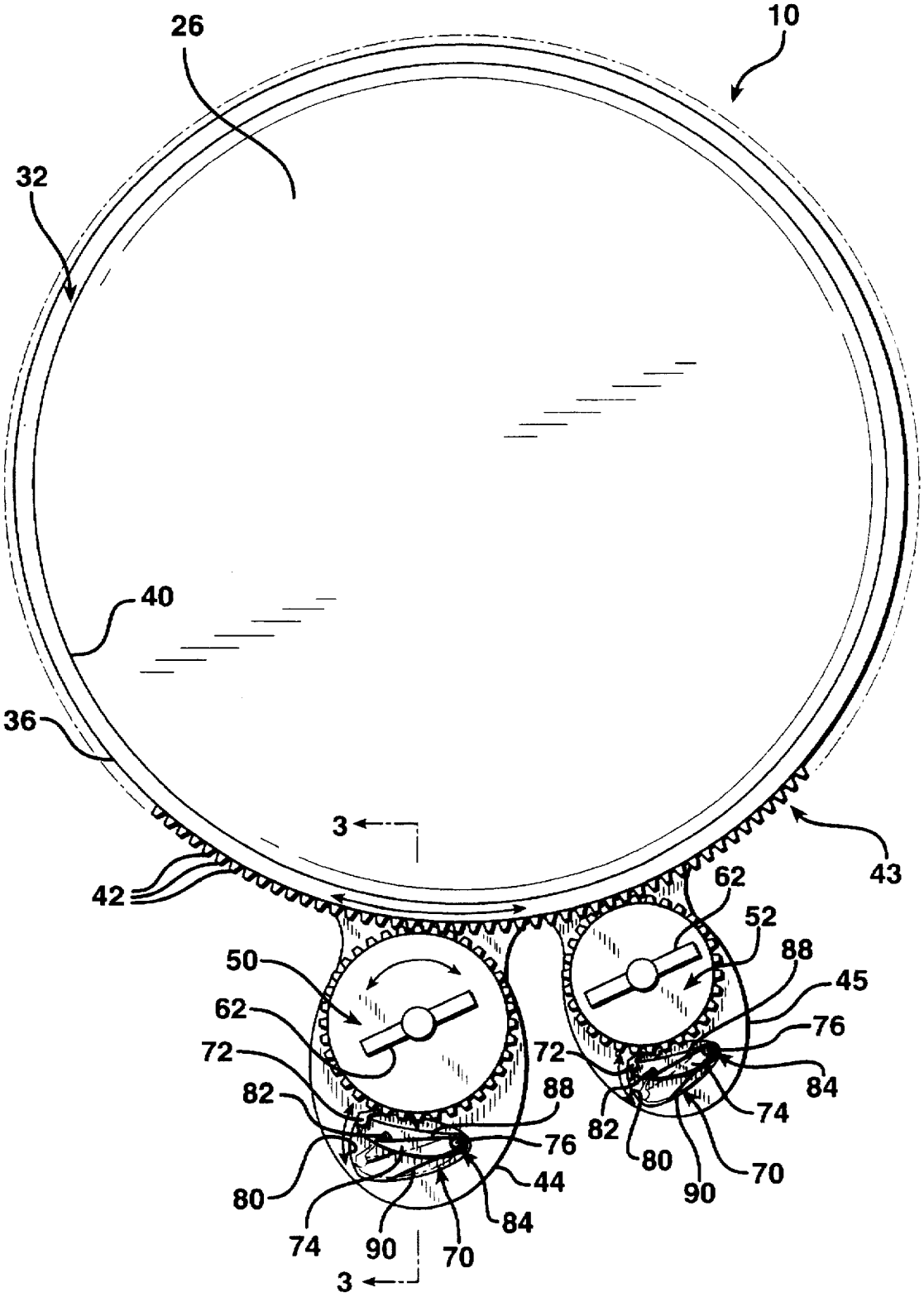
FIG. 2 is a top plan view of the drum of FIG. 1.

An annular counterhoop 32, having an inverted, generally J-shaped or U-shaped cross section is shown in cross section FIG. 2. The counterhoop 32 is formed with a downwardly facing, annular groove 34 therein that receives the tuning rim 16. The counterhoop 32 has an outer tensioning band 36 with radially inwardly directed screw threads 38 defined thereon. The counterhoop 32 also includes an inner, annular pressure ring 40 that resides in the channel 22 and bears longitudinally against the hoop 30. A connecting web or bridging portion 41 of the counterhoop 32 rigidly joins the tensioning band 36 to the pressure ring 40. The counterhoop web 41 spans the tuning rim 16 and passes thereover in spaced, longitudinal separation therefrom. The drum skin 26 is tightened across the bearing ring 20 by screwing the tensioning band 36 further onto the tuning rim 16 and is loosened by unscrewing the tensioning band 36 from the tuning rim 16.

As best illustrated in FIG. 1, the outwardly facing outer surface of the lower extremity of the tensioning band 36 of the counterhoop 32 is provided with a plurality of radially outwardly directed ring gear teeth 42 thereon, which collectively form a ring gear 43. Also, a pair of generally flat, obloid-shaped gear mounts 44 and 45 are secured to the outer wall of the tuning collar 15 and project radially outwardly therefrom.

Each of the gear mounts 44 and 45 has essentially the same configuration and same structural arrangement of elements, although the gear mount 44 is somewhat larger than the gear mount 45. The radially inwardly facing surfaces of the gear mounts 44 and 45 conform to the curvature of the outer surface of the tuning collar 15 against which they bear. The gear mounts 44 and 45 are each secured to the tuning collar 15 by means of a pair of radially directed screws 46 that pass through the structure of the tuning collar 15 beneath the threads 18 and into internally tapped holes in the gear mounts 44 and 45.

Each of the gear mounts 44 and 45 is provided with a vertical gear shaft opening 48 spaced radially outwardly from the surface of contact of the gear mounts 44 and 45 with the tuning collar 15. The gear mounts 44 and 45 are provided with driving gears 50 and 52, respectively. The driving gears 50 and 52 are both spur gears with teeth 54 thereon that mesh with the radially upwardly projecting ring gear teeth 42 on the counterhoop 32. However, the driving gears 50 and 52 differ in pitch diameter.

The gear 50 is designed to effectuate coarse or gross tuning of the drum 10 and preferably has a pitch diameter PD of 1.5 inches. The pitch diameter of the ring gear 43 formed by the teeth 42 is fifteen inches. Therefore, there is a ten to one ratio between the pitch diameter of the ring gear 43 and the pitch diameter of the coarse tuning gear 50. That is, it would be necessary to turn the driving gear 50 through ten complete rotations in order to rotate the ring gear 43 three hundred sixty degrees.

The coarse tuning driving gear 50 has a specification of DP equal to twenty-four. That is, there are twenty-four teeth for each inch of pitch diameter in the coarse tuning driving gear 50. The gear 50 also has a pressure angle PA of twenty degrees. The tooth thickness at the pitch diameter ($t_{nom}$) of each gear tooth 54 on the coarse tuning driving gear 50 at its pitch diameter is 0.06545 inches. The specification for the wire diameter of the coarse tuning driving gear 50 is 0.072. That is, a wire of 0.072 inches in diameter will fit between the teeth 54 of the gear 50 and just project above the outer diameter of the gear 50. The $M_{nom}$ for the gear 50 is 1.6007. That is, 1.6007 is the outer diameter of the gear 50 as measured over the wires $t_{nom}$.

The center distance between the ring gear 43 formed by the ring gear teeth 42 and the gear 50 is 8.2500 inches. That is, the distance between the axial center of the ring gear 43 and the axial center of gear 50 is 8.2500 inches.

The specifications of the fine tuning driving gear 52 differ slightly from those of the coarse tuning driving gear 50. Specifically, the fine tuning driving gear 52 has thirty teeth and a pitch diameter PD of 1.2500 inches. Consequently, the gear ratio of the ring gear 43 relative to the fine tuning driving gear 52 is twelve to one. The $M_{nom}$ specification for the gear 52 is 1.3504 while the center-to-center distance between the ring gear 43 and the fine tuning driving gear 52 is 8.125 inches.

Other of the gear specifications for the gear 52 are the same as those for the gear 50. Specifically, the pressure angle PA, ($t_{nom}$) measurement, and wire diameter for the gear 52 are the same as those of the gear 50.

Each of the driving gears 50 and 52 is mounted on a vertically oriented shaft 56 that extends down through the shaft opening 48 in the respective gear mounts 44 and 45. A radial channel 60 is defined in the shaft 56 near the lower tip thereof. The channel 60 is adapted to receive a C-ring 61 which holds the gears 50 and 52 atop their respective gear mounts 44 and 45 in engagement with the ring gear 43.

The upper extremity of each shaft 56 terminates in a flat plate that forms a key 62 suitable for gripping with the fingers of a person tuning the drum. Rotation of each key 62 in a clockwise direction, as viewed in FIG. 2, tightens the drum skin 26 across the tuning rim 20. Conversely, counterrotation of each key 62 and the driving gear associated therewith in a counterclockwise direction, as viewed in FIG. 2, loosens the tension on the drum skin 26.

The radially outwardly projecting gear teeth 42 on the tensioning band 36 of the counterhoop 32 form a ring gear 43 on the outer surface of the counterhoop 32. The gear teeth 42 reside in meshed engagement with the teeth 54 of both of the driving gears 50 and 52. The driving gears 52 and 54 differ in pitch diameter, so that they are operable to alternatively drive the ring gear 43 at different motion transmission ratios.

Due to the large difference in size of the ring gear and the driving gears 50 and 52, and due to the interaction between the threads 18 and 38, frictional forces alone may well be sufficient to prevent the driving gears 50 and 52 from turning other than by means of an intentional rotation of one or the other of the driving gears 50 and 52 using the key 62 associated therewith. However, as a safeguard against unintended counterrotation of the counterhoop 32, each of the driving gears 50 and 52 is provided with a pawl mechanism indicated generally at 70. Each pawl mechanism 70 for each of the driving gears 50 and 52 is supported, respectively, by the gear mounts 44 and 45. The pawl mechanisms 70 are engageable with their respective gears 50 and 52 to prevent rotation of the driving gears 50 and 52 in a direction that loosens the counterhoop 32 relative to the tuning rim 16.

Figure 4:
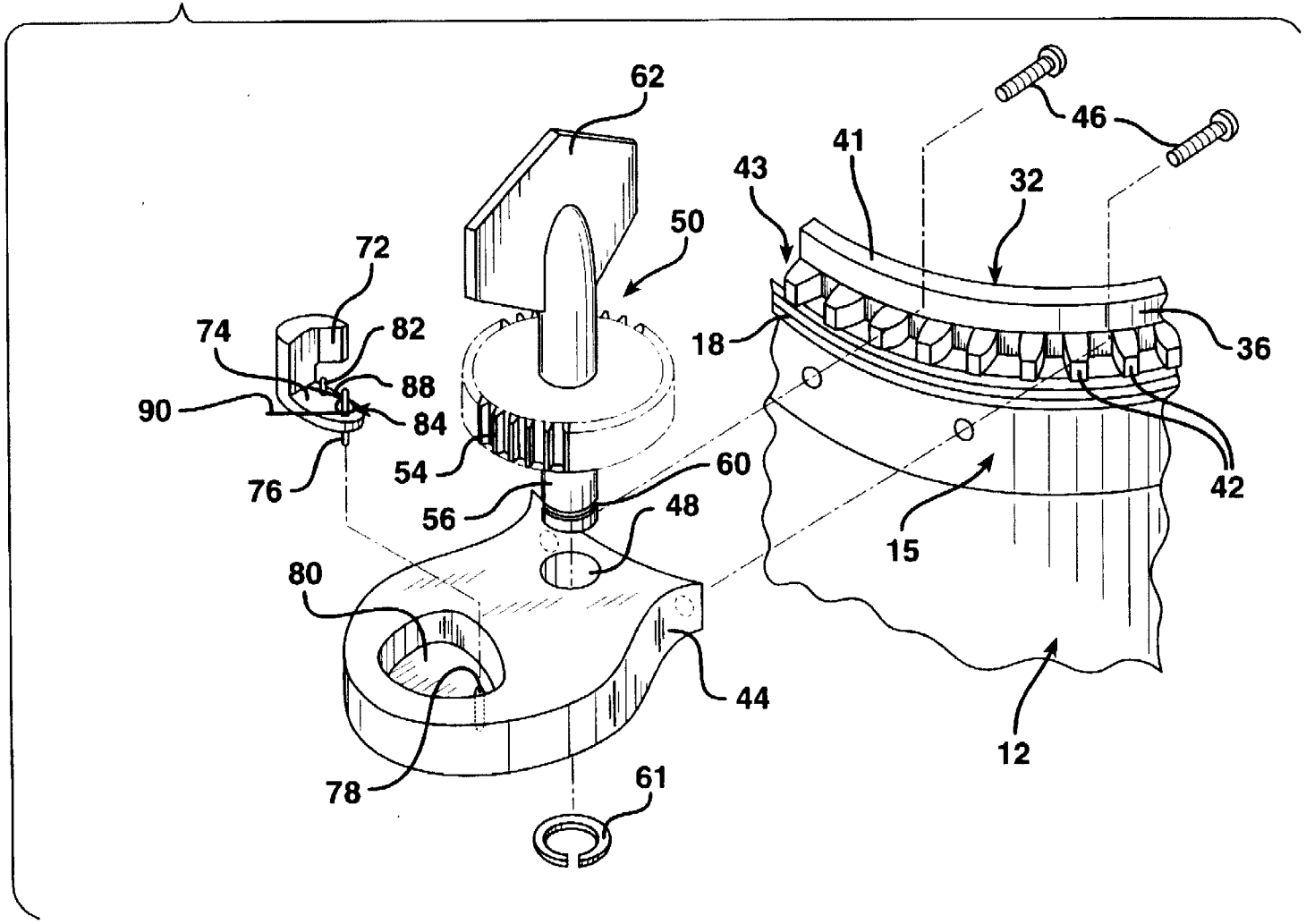
FIG. 4 is an exploded perspective detail view illustrating the tension adjustment system of the invention.

Each pawl mechanism 70 includes a pawl finger 72 mounted on a pawl lever arm 74 that in turn is mounted for rotation on a vertical axle 76 mounted in a vertical axle well 78 at the bottom of a concave, upwardly facing pawl recess 80, as best depicted in FIG. 4. The pawl lever arm 74 of each pawl mechanism 70 is provided with an upstanding bearing post 82 located proximate the pawl finger 72. Each pawl mechanism 70 is provided with a wire, hairpin spring, 84 having a stabilizing coil through which the pawl axle 76 passes, a first leg 88 that bears against the bearing post 82, and a second leg 90 that bears against the radially outermost wall of the pawl recess 80.

When the pawl mechanism 70 is seated in the pawl recess 80, the pawl tooth 72 projects laterally toward the teeth 54 of the associated driving gear 50 or 52 and is biased into engagement therewith by the force of the wire spring 84. The wire spring leg 90 bears against the back wall of the pawl recess 80 while the spring leg 88 bears against the upstanding bearing post 82 in each pawl mechanism. Each spring 84 therefore tends to urge the pawl tooth 72 in a clockwise direction about the pawl axle 76, as viewed in FIG. 2.

The pawl tooth 72 of each pawl mechanism 70 is oriented in such a manner that the tooth 72 is forced back and cams over the tops of passing teeth 54 when the driving gears 50 and 52 are rotated in a counterclockwise direction to screw the counterhoop 32 further onto the tuning rim 16, and thereby tighten the drum skin 26 over the bearing ring 20. However, the pawl teeth 72 tend to latch in between the teeth 54 of their respective driving gears and prevent those driving gears from turning in a clockwise direction to permit counterclockwise rotation of the counterhoop 32. If one desires to loosen tension of the drum skin 26, the pawl teeth 72 must be manually disengaged from the driving gear teeth 54 to permit the driving gears 50 and 52 to turn in a clockwise direction to thereby counterrotate the counterhoop 32 in a counterclockwise direction, thus unscrewing it further from the tuning rim 16.

To operate the drum tuning system of the present invention in a gross or coarse tuning mode, the key 62 that is joined to the shaft 56 of the driving gear 50 is rotated in a counterclockwise direction, as viewed in FIG. 2, to increase tension on the drum skin 26. Because the driving gear 50 is of a larger diameter than the driving gear 52, rotation of the driving gear 50 through a particular angle of rotation imparts a relatively large angular rotation in a clockwise direction to the ring gear 43, as viewed in FIG. 2. This in turn means that the tensioning band 36 will be screwed further onto the tuning rim 16 of the tuning collar 15 a relatively great amount when the key 62 for the gear 50 is rotated in the counter-counterclockwise direction.

As the gear 50 is turned in a counterclockwise direction, the pawl teeth 72 of both pawl assemblies 70 are lifted over each tooth 54 that approaches and passes therebeneath. Once the user is satisfied with the tuning of the drum the pawl teeth 72 will prevent clockwise rotation of the gears 50 and 52 since the wire springs 82 of the pawl assemblies 70 hold the pawl teeth 72 in locking engagement with the gears 50 and 52 unless released.

Should the user decide to loosen the tension on the drum skin 26, both pawl teeth 72 must be pulled back out of engagement from the gear teeth 54. To perform a gross or coarse adjustment to reduce tension on the drum skin 26, the key 62 of the gear 50 is turned in a clockwise direction while holding both pawl teeth 72 clear of the gear teeth 54 by overcoming the bias of the wire springs 84. The key 62 for the gear 50 is turned in a clockwise direction, thereby turning the ring gear 43 in a counterclockwise direction. This unscrews the counterhoop 32 relative to the tuning rim 20, thus reducing some of the pressure that the pressure ring 40 exerts on the hoop 30. When the user is satisfied that tension on the drum skin 26 has been reduced sufficiently, the pawl teeth 72 are released. The wire springs 84 thereby force the pawl teeth 72 back into engagement with the gear teeth 54 and prevent any further retrograde motion. This ensures that the drum skin 26 will not become loosened further when the drum is played.

Ideally the gross or coarse adjustment performed by manipulating the driving gear 50 produces an alteration in frequency of one-half of a musical note for each gear tooth 54 that passes the pawl tooth 72 of the pawl assembly 70 for the driving gear 50. However, due to differences in material or thickness of the drum skin 26, size of the drum shell 12, or other variables, each incremental adjustment of the tuning system in the coarse or gross mode may produce a change in tone of slightly more or less than one-half of a musical note. Therefore a fine tuning capability is highly desirable.

A fine tuning adjustment can be achieved by rotating the key 62 that is joined to the fine tuning driving gear 52. To increase and decrease tension on the drum skin 26, the key 62 that is coupled to the fine tuning driving gear 52 is manipulated in the same way as performing the coarse adjustment utilizing the gear 50. However, since the pitch diameter of the fine tuning gear 52 is smaller than that of the coarse tuning gear 50, rotation of the fine tuning driving gear 52 through a particular arc of angular rotation will rotate the ring gear 43 through a smaller arc than rotation of the coarse tuning driving gear 50 through the same predetermined angular arc. As a consequence, the free tuning driving gear 52 will produce smaller changes in tuning for the same angle of driving gear adjustment than the coarse tuning driving gear 50.

Undoubtedly, numerous other variations and modifications of the invention will become readily apparent to those familiar with the tuning of musical percussion drums. For example, in the embodiment illustrated, tuning is effectuated through manual manipulation of keys 62. However, operation of the gear adjustment system may also be achieved by means of an electrical mechanism operated under computer control. Thus, using an audio detector and feedback loop, a drum can be automatically tuned to its resonance frequency under computer control using a servomotor, if desired.

Also, numerous different gear mechanisms may be employed to achieve different degrees if fineness or coarseness of tuning control. In addition, the axis of rotation about which the tuning gears are rotated need not necessarily be parallel to the axis of the drum. To the contrary, a system of bevel gears or helical gears could be employed. Also, a worm drive could be employed in the transmission of motion, rather than the spur gear systems utilized in the embodiment illustrated. Accordingly, the scope of the invention should not be construed as limited to the specific embodiment depicted and described.

I claim:

1. A musical percussion drum comprised of a drum shell, a tuning collar secured to said drum shell and including an annular bearing ring and a tuning rim coaxially surrounding said bearing ring so as to define an annular channel therebetween and wherein said tuning rim has a radially outwardly facing, externally threaded annular surface, an expansive drum skin stretched across said bearing ring and having a periphery extending down into said channel throughout its entire circumference, a rigid, annular hoop secured to said periphery of said drum skin and residing in said channel, and an annular counterhoop formed with an outer, annular, inwardly facing, threaded portion threadably engaged with said externally threaded surface of said tuning rim, an inner, annular portion disposed in said channel and bearing downwardly upon said annular hoop, and a web joining said inner and outer portions rigidly together longitudinally beyond said tuning rim so that said web spans and is longitudinally displaced from said tuning rim.

2. A drum according to claim 1 further characterized in that said counterhoop is provided with radially outwardly projecting gear teeth, and further comprising a gear mount secured to said tuning collar, and at least one driving gear supported by said gear mount for rotation about a driving gear axis so as to engage said gear teeth on said counterhoop to thereby rotate said counterhoop relative to said drum shell to selectively tighten and loosen said counterhoop relative to said tuning rim.

3. A drum according to claim 2 further comprising a pawl mechanism supported by said gear mount and selectively engageable with said driving gear to prevent rotation of said driving gear in a direction that loosens said counterhoop relative to said tuning rim.

4. A drum according to claim 1 further characterized in that said counterhoop is provided with radially outwardly projecting gear teeth, and further comprising a gear mount means secured to said tuning collar, a plurality of driving gears of different gear pitch diameter all engaged with said gear teeth on said counterhoop and supported by said gear mount means for rotation about parallel driving gear axes, and pitch selection means for engaging a selected one of said driving gears to thereby rotate said counterhoop relative to said drum shell to selectively tighten and loosen said counterhoop relative to said tuning rim at a selected mechanical advantage.

5. A drum according to claim 4 further comprising at least one pawl mechanism supported by said gear mount means and engageable with at least one of said driving gears to prevent rotation of said driving gears in a direction that loosens said counterhoop relative to said tuning rim.

6. A drum according to claim 1 further characterized in that said counterhoop is provided with radially outwardly projecting teeth, and further comprising at least a pair of driving gears selectively engageable to rotate said counterhoop at different motion transmission ratios.

7. In a musical percussion drum having an expansive drum skin, an annular drum shell formed with an annular bearing ring across which said drum skin is stretched, an annular channel surrounding said bearing ring, and an annular hoop secured to the periphery of said drum skin and residing in said channel, the improvement wherein said drum shell is provided with a tuning rim disposed coaxially about said hoop and surrounding said channel and having a radially outwardly facing, external, cylindrical surface with threads formed thereon, and further comprising an annular counterhoop formed with an outer tensioning band with an inwardly facing, internally threaded, cylindrical surface threadably engaged with said externally threaded surface of said drum shell tuning rim, an annular pressure ring disposed in said channel, and a bridging section longitudinally displaced from said tuning rim and rigidly joining said pressure ring to said outer tensioning band, whereby the position of said pressure ring in said channel is determined by the extent of advancement of said internally threaded surface of said outer tensioning band onto said externally threaded surface of said tuning rim.

8. A musical percussion drum according to claim 7 further characterized in that said tensioning band is provided with radially outwardly directed gear teeth, and further comprising a plurality of tension adjustment gears of different pitches secured relative to said drum shell and engaged with said gear teeth on said tensioning band.

9. A musical percussion drum according to claim 8 further comprising a tuning collar secured to said drum shell and forming said bearing ring, said channel, and said tuning rim.

10. A musical percussion drum according to claim 9 further comprising key means for driving said tension adjustment gears.

11. A musical percussion drum according to claim 7 further comprising a plurality of tension adjustment gears including at least first and second driving gears selectively engageable to drive said counterhoop in rotation at different mechanical advantages.

12. A musical percussion drum according to claim 11 further comprising at least one pawl selectively engageable with said tension adjustment gears to prevent rotation of said counterhoop in a direction that loosens tension on said drum skin.

13. A musical percussion drum comprising a drum shell, an annular tuning rim having an externally threaded, radially outwardly facing, outer surface, an annular bearing ring disposed coaxially within said tuning rim and separated therefrom by an annular channel, an expansive drum skin residing in contact with said bearing ring throughout the circumference thereof and having a peripheral region extending radially outwardly beyond said bearing ring and into said channel, an annular hoop secured to said peripheral region of said drum skin and residing in said channel, and an annular counterhoop formed with an annular groove that receives said tuning rim therewithin and which has an outer tensioning band portion with radially inwardly directed threads defined thereon, an inner pressure ring portion which resides in said channel and bears longitudinally against said annular hoop and a connecting portion that rigidly joins said tensioning band portion to said pressure ring portion and which spans said tuning rim and passes thereover in spaced separation therefrom, whereby said drum skin is tightened by screwing said tensioning band further onto said tuning rim and loosened by further unscrewing said tensioning band from said tuning rim.

14. A drum according to claim 12 wherein said tensioning band is provided with radially outwardly directed gear teeth thereon, and further comprising tension adjustment gear means having a plurality of speeds secured relative to said drum shell and having at least one gear engaged with said gear teeth on said tensioning band, and further comprising a key for operating said tension adjustment gear means to rotate and counterrotate said at least one gear at selectable different mechanical advantages.

15. A drum according to claim 14 wherein said tension adjustment gear means includes at least a first driving gear engageable to provide gross tuning adjustment and at least a second driving gear engageable to provide fine tuning adjustment.

16. A drum according to claim 15 further comprising a pawl means selectively engageable to prevent unscrewing of said tensioning band from said tuning rim.

* * * * *